US007008177B2

(12) United States Patent
Britt et al.

(10) Patent No.: US 7,008,177 B2
(45) Date of Patent: Mar. 7, 2006

(54) CENTRIFUGAL PUMP WITH SELF COOLING AND FLUSHING FEATURES

(75) Inventors: Timothy D. Britt, Columbus, IN (US); Randall J. Stafford, Columbus, IN (US); Donald W. Stanton, Columbus, IN (US)

(73) Assignee: Cummins Inc., Columbus, IN (US)

( * ) Notice: Subject to any disclaimer, the term of this patent is extended or adjusted under 35 U.S.C. 154(b) by 116 days.

(21) Appl. No.: 10/705,207

(22) Filed: Nov. 10, 2003

(65) Prior Publication Data

US 2004/0136826 A1 Jul. 15, 2004

Related U.S. Application Data

(60) Provisional application No. 60/426,149, filed on Nov. 14, 2002.

(51) Int. Cl.
*F04D 29/58* (2006.01)

(52) U.S. Cl. ..... 415/111; 415/231

(58) Field of Classification Search ..... 415/111–113, 415/174.2, 174.3, 231
See application file for complete search history.

(56) References Cited

U.S. PATENT DOCUMENTS

| | | | |
|---|---|---|---|
| 1,386,219 | A | 8/1921 | Archer |
| 1,460,982 | A | 7/1923 | Records |
| 1,664,572 | A | 4/1928 | Poulsen |
| 1,867,290 | A | 7/1932 | Vitu |
| 1,871,747 | A | 8/1932 | Schlachter |
| 2,028,783 | A | 1/1936 | Jacobsen |
| 2,101,960 | A | 12/1937 | Sjöström |
| 2,331,641 | A | 10/1943 | Walker |
| 2,352,636 | A | 7/1944 | Jackman |
| 2,361,521 | A | 10/1944 | Yates |
| 2,375,085 | A | 5/1945 | Curtis |
| 2,407,218 | A | 9/1946 | Beier |
| 2,641,190 | A | 6/1953 | Johnson |
| 2,671,406 | A | 3/1954 | Waller |
| 2,791,182 | A | 5/1957 | Scheidl |
| 2,843,404 | A | 7/1958 | Janety |
| 2,859,698 | A | 11/1958 | Buehler |
| 3,001,517 | A | 9/1961 | Baker et al. |
| 3,037,458 | A | 6/1962 | Olmstead et al. |
| 3,070,028 | A | 12/1962 | Loy et al. |
| 3,071,075 | A | 1/1963 | Spring |
| 3,074,349 | A | 1/1963 | Zimmermann |
| 3,088,416 | A | 5/1963 | Danis |
| 3,128,713 | A | 4/1964 | Nechine |
| 3,160,108 | A | 12/1964 | Sence |
| 3,203,353 | A | 8/1965 | Ruby |
| 3,354,529 | A | 11/1967 | James |
| 3,371,612 | A | 3/1968 | Aller |
| 3,541,607 | A | 11/1970 | Greene |
| 3,551,067 | A | 12/1970 | Wissman |
| 3,576,380 | A | 4/1971 | Sargeant |
| 3,581,504 | A | 6/1971 | Andrus |
| 3,594,102 | A | 7/1971 | Oden |
| 3,614,272 | A | 10/1971 | Lightfoot et al. |
| 3,663,117 | A | 5/1972 | Warren |

(Continued)

*Primary Examiner*—Ninh H. Nguyen
(74) *Attorney, Agent, or Firm*—Woodard, Emhardt, Moriarty, McNett & Henry LLP

(57) ABSTRACT

A fluid pump including provisions for cooling and/or flushing in the vicinity of a static seal. In one embodiment, the invention includes an open channel fluid passageway defined on a generally flat surface of a pump housing. A centrifugal rotor with a generally flat backplate rotates proximate a surface of the housing. The fluid passageways are adapted and configured to have a pathway that includes a directional component parallel to the direction of rotation, such that fluid drag from the rotating backplate induces flow within the passageway. The passages of the exit can be positioned such that flow exiting the passageway is at least partly tangential to the seal and/or the seal housing.

23 Claims, 7 Drawing Sheets

U.S. PATENT DOCUMENTS

| | | | | | |
|---|---|---|---|---|---|
| 3,664,760 | A | | 5/1972 | Reiner | |
| 3,791,773 | A | | 2/1974 | Maginnis | |
| 3,816,020 | A | | 6/1974 | Ogles | |
| 3,914,072 | A | * | 10/1975 | Rowley et al. | 417/423.11 |
| 3,948,492 | A | | 4/1976 | Hege | |
| 3,966,363 | A | | 6/1976 | Rowley et al. | |
| 4,128,362 | A | | 12/1978 | Shepherd et al. | |
| 4,193,949 | A | | 3/1980 | Naito | |
| 4,744,722 | A | | 5/1988 | Sampi et al. | |
| 4,780,051 | A | | 10/1988 | Fisher, Jr. | |
| 5,156,522 | A | | 10/1992 | Tessier | |
| 5,195,867 | A | | 3/1993 | Stirling | |
| 5,336,048 | A | | 8/1994 | Ganzon et al. | |
| 5,385,443 | A | | 1/1995 | Dufour | |
| 5,386,598 | A | | 2/1995 | Mersmann | |
| 5,409,350 | A | * | 4/1995 | Mitchell | 415/111 |
| 5,427,500 | A | | 6/1995 | Hyll | |
| 5,489,187 | A | | 2/1996 | Ray | |
| 5,591,001 | A | * | 1/1997 | Ray et al. | 415/111 |
| 5,658,127 | A | | 8/1997 | Bond et al. | |
| 5,713,719 | A | | 2/1998 | Fiore et al. | |
| 5,772,396 | A | | 6/1998 | Rockwood | |
| 5,827,041 | A | | 10/1998 | Charhut | |
| 6,099,243 | A | | 8/2000 | Fiore | |

* cited by examiner

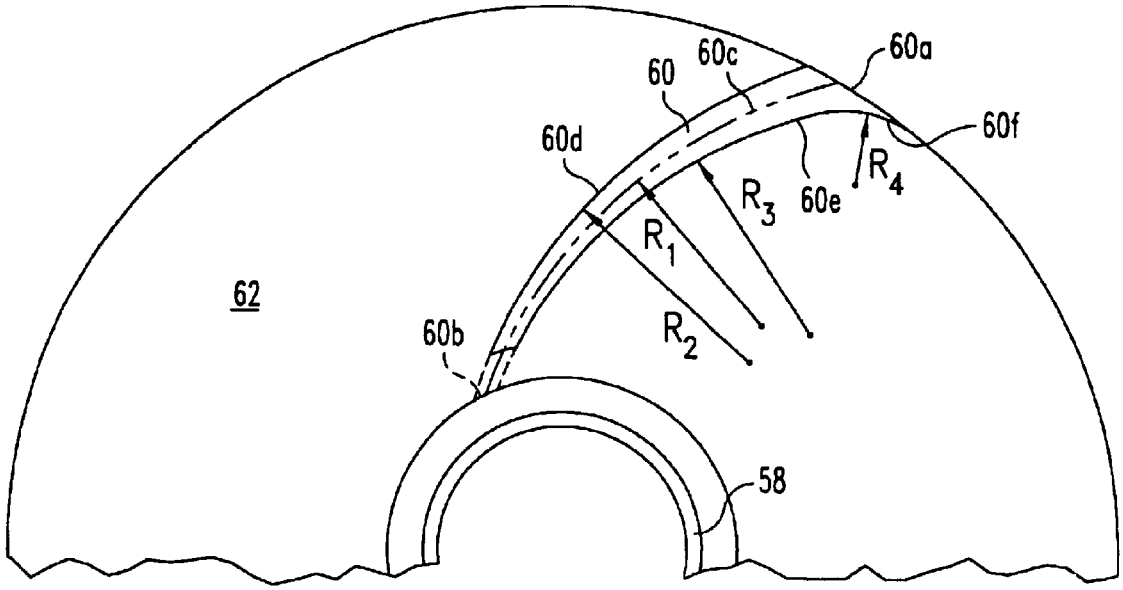
Fig. 4A
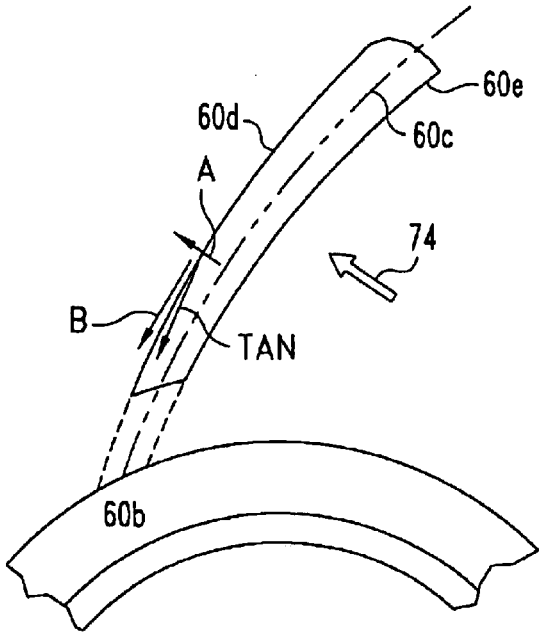
Fig. 4B
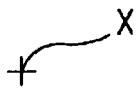

CENTRIFUGAL PUMP WITH SELF COOLING AND FLUSHING FEATURES

This application claims the benefit of priority to U.S. provisional patent application Ser. No. 60/426,149, filed Nov. 14, 2002, which is incorporated herein by reference.

FIELD OF THE INVENTION

The present invention relates to pumping elements having static seals, and in particular centrifugal water pumps.

BACKGROUND OF THE INVENTION

Many pumps include a static seal that is in contact with a rotating seal. These two seals co-act to minimize leakage out of the housing of the pump. However, since there is a frictional interface of the rotating seal sliding on the static seal, these seals can also coact to create heat from sliding friction. This heat can provide several deleterious effects including increased seal wear and also formation of vapor bubbles.

To overcome these adverse affects, some pumps incorporate secondary cooling passages that provide a cooling medium to the seal interface to reduce the temperature. For example, in a centrifugal pump, the cooling passage may connect the high pressure fluid exiting the pump with a region of lower pressure near the inner diameter of the pump.

However, some pumps include fluid passageways of simple shape which do not provide optimum protection for the pump seals. Further, some newer pumps are required to work in hotter applications where the removal of heat from the frictional seal interface is critical. Sometimes the simply shaped fluid passageways provide inadequate cooling flow such that reasonable operating temperatures cannot be achieved. In yet other applications the pressure of the cooling fluid in the vicinity of the seal is too low to prevent the formation of vapor bubbles and damage by cavitation. In yet other applications, the fluid passageway is directed toward the centerline of the rotor, such that there is no tangentially-directed fluid to flush debris away from the seal interface.

The present invention provides solutions to these problems in novel and unobvious ways.

SUMMARY OF THE INVENTION

The present invention includes multiple embodiments that relate to various methods and apparatus for cooling a seal within a pump which includes a rotating member.

In one embodiment, the present invention includes at least one fluid passageway that directs fluid toward a seal element, with the fluid flow including a component that is generally tangential to the seal element.

In yet another embodiment, the pump includes a passageway providing fluid directed at a seal, the passageway having at least a portion thereof with a decreasing cross sectional area such that the fluid accelerates toward the seal area.

Yet another aspect of the invention concerns a curving, open-channel fluid passageway that is arranged and configured such that rotation of the pump rotor over the fluid passageway increases the velocity of the fluid flowing in the passageway. Yet other aspects of the invention concern closed-channel fluid passageways.

These and other objects and advantages of the present invention will be apparent from the drawings, description, and claims to follow.

DESCRIPTION OF THE DRAWINGS

FIG. 4A is an enlargement of a portion of the housing of FIG. 3.

FIG. 4B is an enlargement of a portion of FIG. 4A

DESCRIPTION OF THE PREFERRED EMBODIENT

Figure 1:
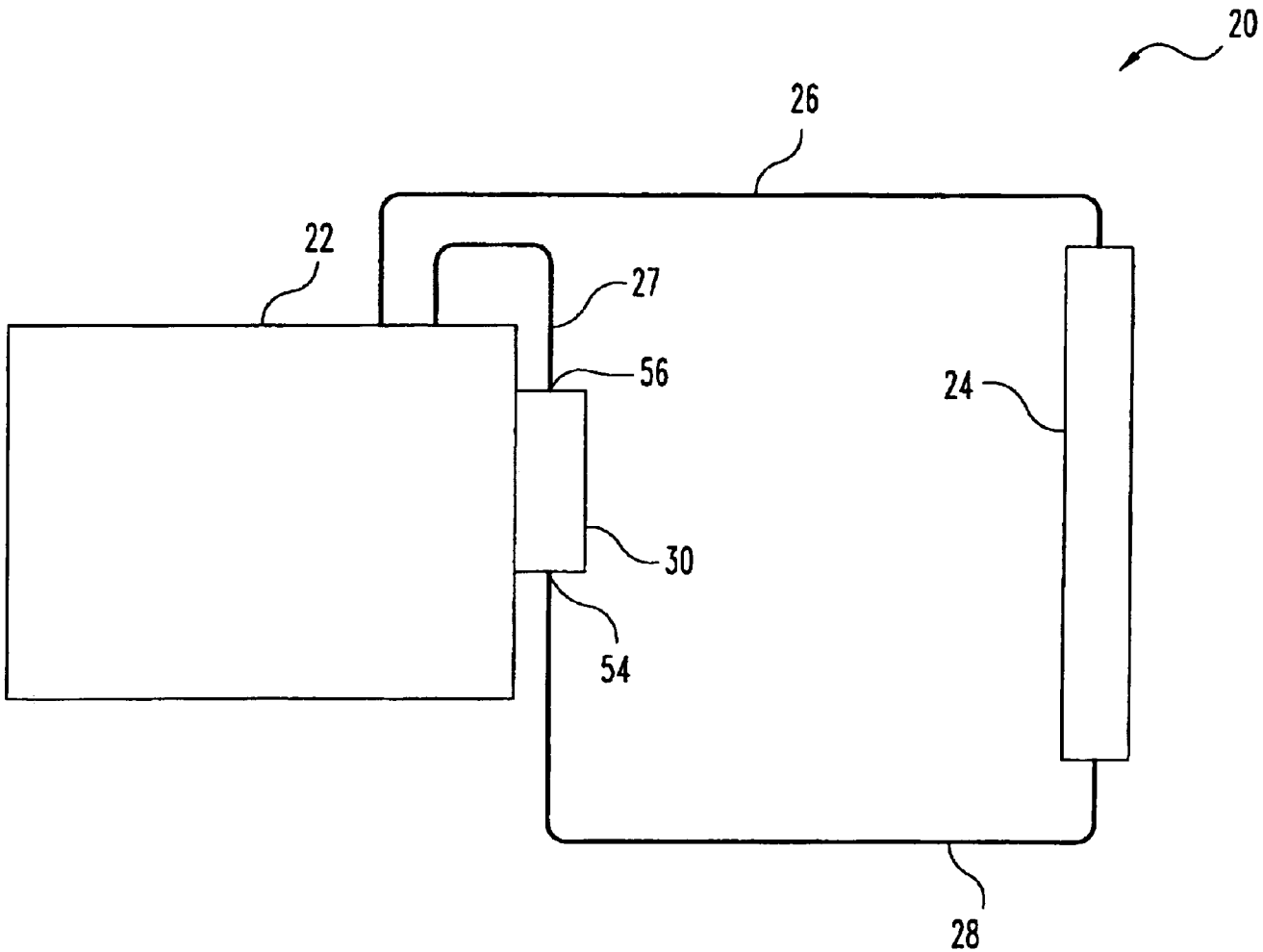
FIG. 1 is a schematic representation of an engine, pump, and heat exchanger according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention relates to method and apparatus for cooling and flushing a seal of a pump assembly which includes a rotating member.

In one embodiment, the assembly includes a rotating centrifugal element rotating within a pump housing. The pump housing includes one or more grooves for channels which direct the flow of fluid toward a static seal member or the housing thereof. In one embodiment, the grooves or fluid passageways have at least a portion thereof curved in shape. As a portion of the pump rotor, such as the backplate, travels across the curved fluid passageway, fluid drag from the rotating member imparts energy into the fluid within the passageway and increases the velocity and/or pressure of the fluid flowing in the curved passageway. In yet another embodiment, the fluid passageway includes at least a portion thereof with a cross-sectional area that decreases in the direction toward the static seal. This decrease in cross-sectional area causes a subsequent increase in the velocity of the fluid flowing within the passageway.

In various embodiments of the present invention, the fluid directed at the static seal has increased velocity. This higher fluid velocity results in increased convective heat transfer away from the static seal and into the cooling fluid. This reduces the temperature of the seal. Further, the increased velocity of the fluid in the fluid passageway results in a higher pressure within the chamber surrounding the static seal. In some embodiments, this increase in seal cooling and increase in seal chamber pressure results in an overall reduction in the formation of vapor bubbles within the seal chamber and a subsequent reduction in damage from cavitation. In some embodiments, the higher flow end near the seal provides lubrication of the sliding interface and also provides flow to flush debris away from the seal.

FIG. 1 is a schematic representation of an apparatus 20 according to one embodiment of the present invention. Apparatus 20 includes an internal combustion engine 22, such as a diesel engine. A heat exchanger 24 is provided to dump waste heat from engine 22. A pump 30 driven by engine 22 circulates a cooling fluid through fluid lines 26, 27, and 28 from engine 22 to heat exchanger 24. The present invention also contemplates other embodiments not including an engine. These alternate embodiment include any apparatus in which it is desired to pump fluid from one system or container to another system or container, and in which it is desirable to cool and/or flush a seal of the pump.

FIGS. 2–5 present various views of a pump assembly 30 according to one embodiment of the present invention. In one embodiment, pump 30 is of the centrifugal variety, and includes a centrifugal rotor assembly 40 rotatably received within a housing 38 and rotatable about centerline X. Rotor assembly 40 preferably includes a splined shaft 42 which receives torque from a pulley or drive pad of engine 22. Rotor 40 further includes a hub section 44 coupling shaft 42 to centrifugal element 43. Centrifugal element 43 includes a plurality of curved pumping elements 48 which are preferably integrally cast with a backplate 46. As is typical of centrifugal pumps, rotor element 43 accepts fluid from a rotor inner diameter 39. Rotation of element 43 results in pumping elements 48 imparting a velocity to the fluid as it is centrifuged toward rotor outer diameter 41.

Figure 3:
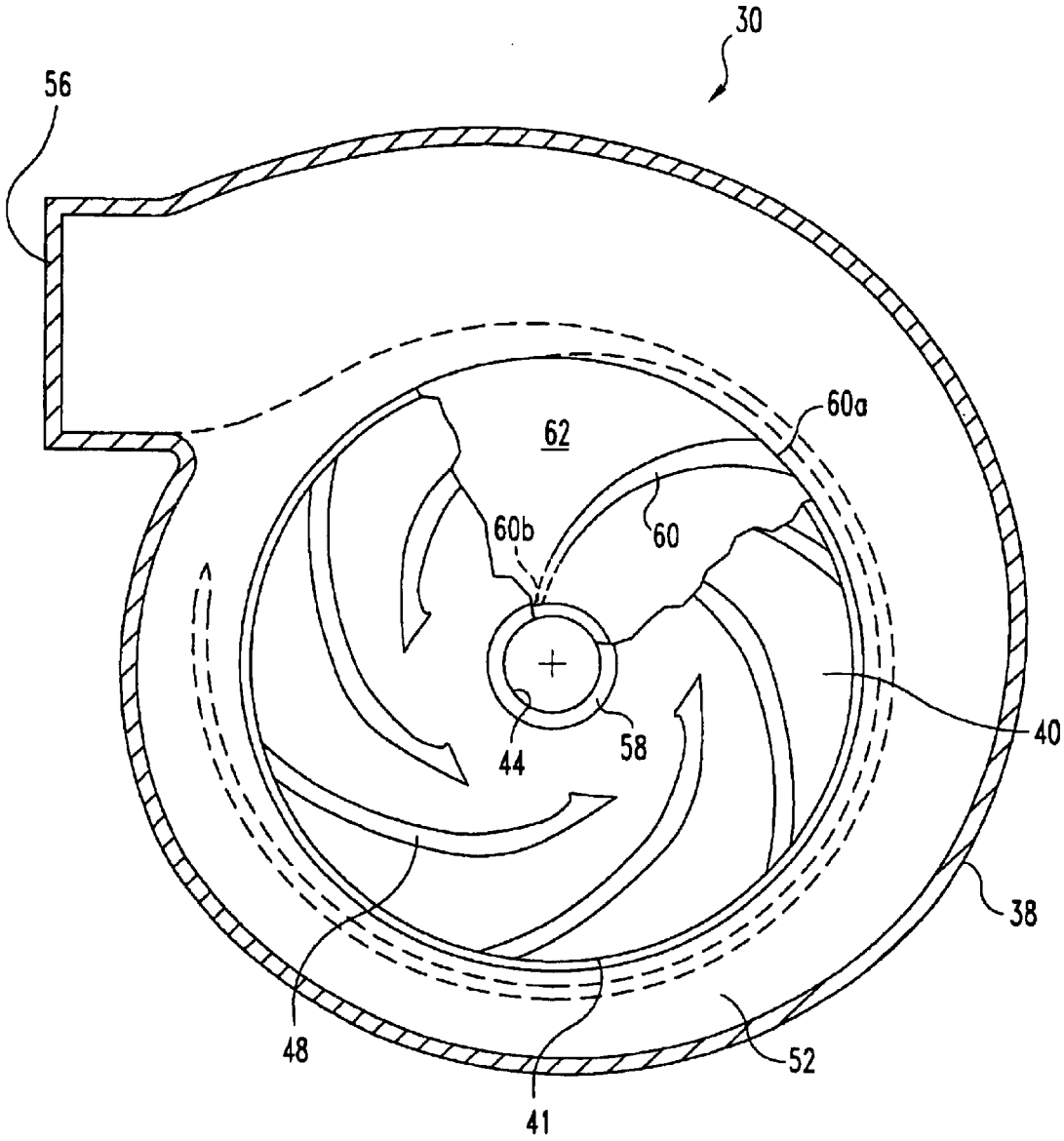
FIG. 3 is a view of the pump of FIG. 2 as taken along the line of 3—3 of FIG. 2, with a portion of the pump rotor removed.

Housing 38 rotatably supports centrifugal rotor assembly 40 along shaft 42 thereof preferably by a pair of ball bearings 50, although the present invention also contemplates those embodiments with single bearings and also those embodiments with plain bearings and roller bearings. Housing 38 includes a generally flat surface 62 which is spaced apart from and faces a generally flat surface 63 of backplate 46 of rotor assembly 40. As rotor assembly 40 rotates within housing 38, surface 63 rotates over static surface 62. As best seen in FIG. 3, housing 42 includes a scroll-shaped fluid pumping path 52 which accepts fluid pumped from outer diameter 41 of rotor element 43, and decelerates the fluid so as to increase its pressure. The higher pressure fluid exits from outlet 56, from where it is provided to engine 22. Fluid leaving heat exchanger 24 is subsequently received within input 54 of housing 38.

Pump 30 includes a first rotating seal member 70 and a second static seal member 72 which prevent and/or reduce leakage of fluid from pump 30. Seal members 70 and 72 act together to prevent and/or reduce leakage. In one embodiment, neither seal member 70 nor seal member 72 prevent or reduce leakage by themselves, without the benefit of co-action with the other member. However, the present invention contemplates other types of seal members which can independently prevent and/or reduce leakage of fluid from pump 30. First rotating seal member 70 is coupled to and rotates with hub 44 of centrifugal rotor assembly 40. As examples, the present invention contemplates embodiments in which seal member 70 is a press-fit on hub 44, and also those embodiments in which seal member 70 is a press-fit onto other rotating portions of rotor assembly 40. Further, the present invention contemplates methods of coupling seal member 72 rotor assembly 40 without a press-fit. Second static seal member 72 is statically held within a seal housing 58 of pump housing 38. Seal members 70 and 72 each include a surface in contact with the other seal member. Therefore, rotation of rotor assembly 40 within housing 38 creates friction at the contact between seal members 70 and 72. Any fluid leaking past seal number 72 exits pump 30 through drainage port 69.

In some embodiments, housing surface 62 includes one or more grooves or fluid passageways that permit flow of higher pressure fluid from rotor outer diameter 41 toward hub 44, seal members 70 and 72, and seal housing 58. Preferably, these fluid passageways are open channels placed within housing surface 62. Referring to FIG. 3, a cross-section of pump 30 is shown with a portion of rotor assembly 40 removed. A fluid passageway 60 is shown within surface 62 of housing 38. Fluid passageway 60 extends on surface 62 from a passageway inlet 60*a* located near outer diameter 41 of rotor 40 along an arcuate path toward an exit 60*b* proximate hub 44. Although what has been shown and described are open channel passageways fabricated into housing surface 62, the present invention also contemplates those embodiments in which some or all of the passageway is a closed channel, such as a partially closed channel which is cast, bored, drilled, or electrodischarge machined, for example, into housing 38. It is understood that an open channel passageway includes at least a portion which is open to the surface of the hub housing, and can include one or more portions of the channel which are enclosed.

Figure 2:
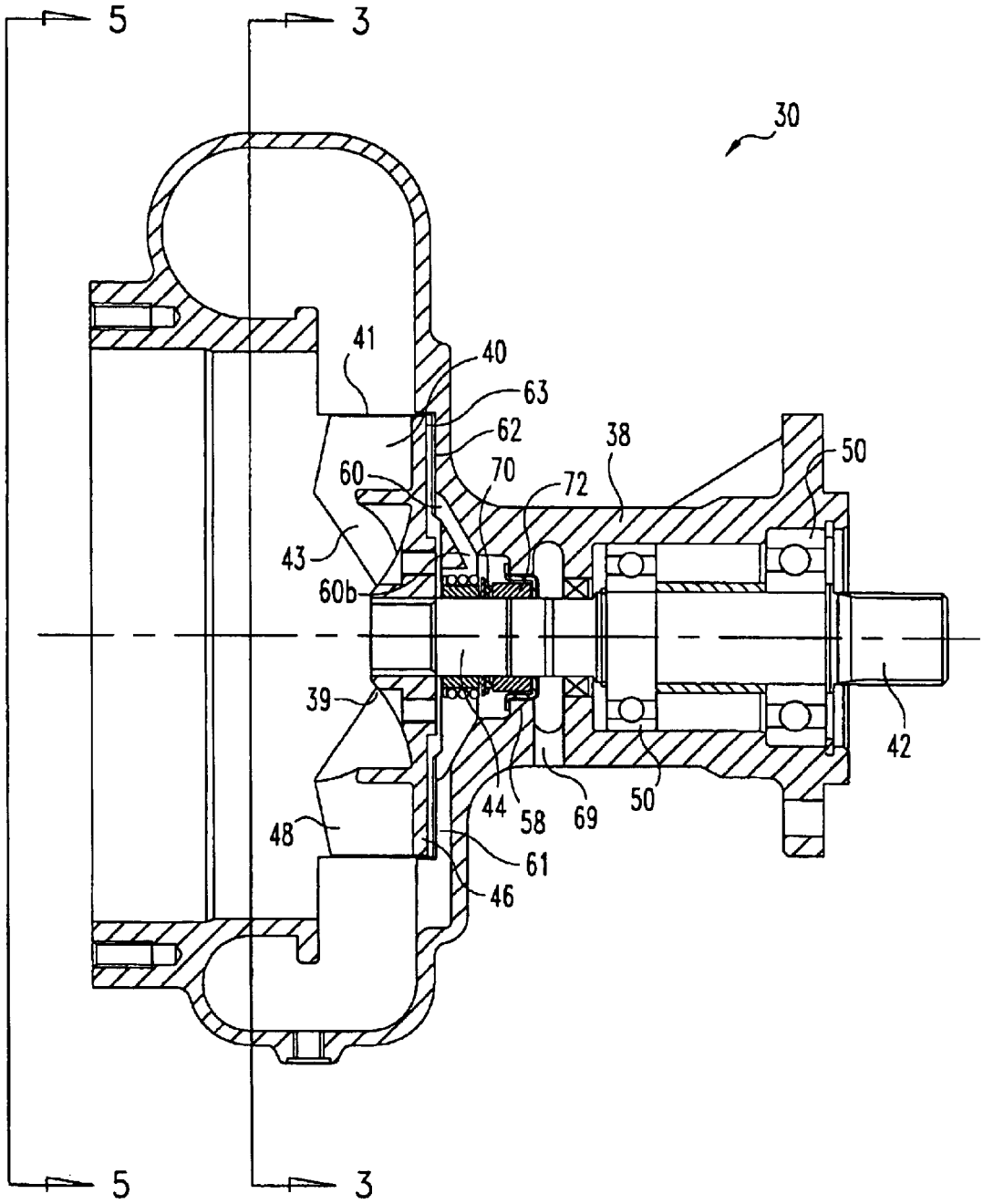
FIG. 2 is a cross-sectional view of a pump according to one embodiment of the present invention.

FIG. 4A shows an enlargement of a portion of the housing 38 shown in FIG. 3. In one embodiment, passageway 60 is directed along a path which includes a centerline 60*c* which extends from inlet 60*a* toward exit 60*b*. Preferably, centerline 60*c* is of a first radius R1 shows such that the exit 60*b* near seal housing 58 includes a directional component that is tangential to seal housing 58. Fluid passageway 60 includes an outer wall and boundary 60*d* formed along a second radius R2. Passageway 60 includes another outer wall and boundary 60*e* formed along a radius R3. Walls 60*d* and 60*e* each intersect surface 62, thus defining an open channel passageway. The radiuses R1, R2, and R3 are chosen based on the flow characteristics and size of the pump. In some embodiments, radius R1 is different than radius R2 or radius R3. In some embodiments, radius R2 and R3 are chosen such that the cross sectional shape of passageway 60 generally decreases in the direction from inlet 60*a* toward exit 60*b*, thereby accelerating the flow of fluid within the passageway. As best seen in FIG. 2, exit 60*b* has a ramped lower surface and a ramped upper surface such that flow exiting from exit 60*b* is directed toward the portion of seal member 70 in contact with seal member 72. In other embodiments, inlet 60*a* includes a leading edge 60*f* which is formed along a radius R4. Radius R4 is chosen to minimize turbulence at the inlet to the passageway.

Although what has been shown and described are passageways which include centerlines, walls, and boundaries, which can be described with a single radius acting about a central point, the present invention also contemplates those embodiments in which the various centerlines, walls, and boundaries of the passageway include one or more piecewise linear segments which approximate circular arcs. Further, the present invention contemplates those passageways where the centerlines, walls, and boundaries which are curved and/or piecewise linearly approximated along parabolic paths and curved paths of higher mathematical order, as examples.

Figure 5:
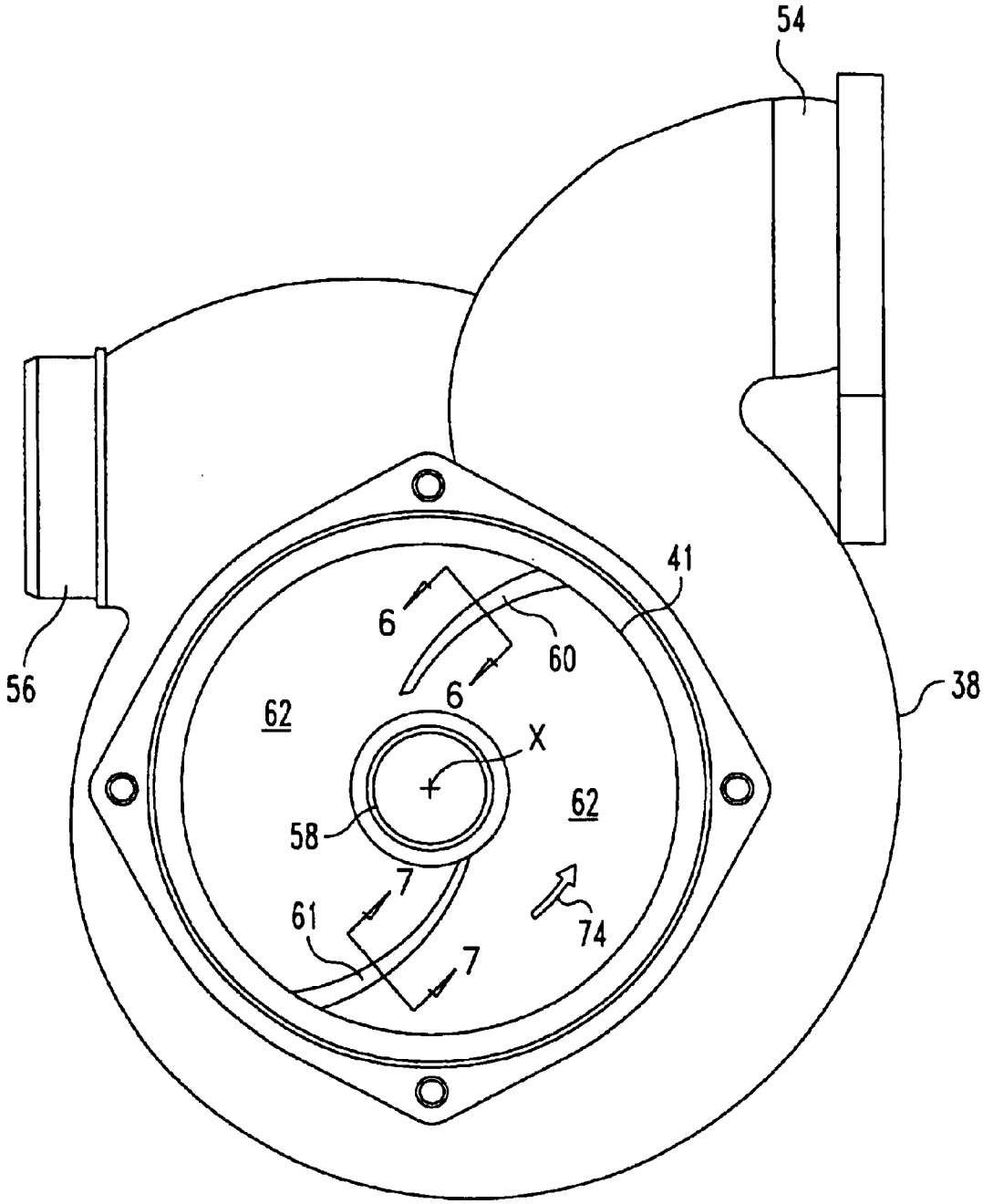
FIG. 5 is an end view of the pump in FIG. 2 as taken along line 5—5 of FIG. 2.

Fluid passageways 60 and 61 have been depicted and described with a cross-sectional area that decreases in a direction from rotor outer diameter 41 to seal housing 58. As shown in FIG. 5, the decrease in cross-sectional area can be achieved by decreasing the width of the fluid passageways, for example by having walls 60*d* and 60*e* approach each other (as best seen in FIG. 4A). However, the present invention also includes those embodiments in which walls 60*d* and 60*e* are generally parallel to each other, but floor 60*f* (referring to FIG. 6) changes elevation in a manner such that the depth of fluid passageway 60 decreases in a direction from outer diameter 141 toward seal housing 58. Further, the present invention also contemplates those embodiments in which the decrease in cross-sectional area is achieved by a combination of decreasing passageway width and decreasing passageway depth. In addition, the present invention contemplates those embodiments in which the depth from surface 62 increases in a direction from the outer diameter toward the seal housing, combined with a decrease in passageway width, with the net result that the cross-sectional area of the passageway decreases in the direction from the rotor outer diameter toward the seal housing.

FIGS. 5–9 depict various features of the fluid passageway. Referring to FIG. 5, directional arrow 74 indicates the direction of rotation of rotor assembly 40. As best seen in FIG. 2, surface 63 of backplate 46 is spaced away from housing surface 62, and rotates over and across housing surface 62. Because of frictional drag from backplate surface 63, fluid between surfaces 62 and 63 rotates along with rotor assembly 40. Referring again to FIG. 5, open channel passageways 60 and 61 are both shaped such that the centerlines of the passageways include a directional component parallel to the direction of rotation of rotor assembly 40, and also a directional component directed from outer diameter 41 toward inner diameter 39 and centerline X.

Because of fluid drag effects from backplate surface 63 acting on any fluid adjacent the backplate and also because of the shape of the fluid passageways, the fluid within passageways 60 and 61 are induced by rotor rotation to flow in a direction from the rotor outer diameter 41 toward rotor inner diameter 39. Drag from backplate surface 63 imparts energy in the rotational direction to any fluid in passageway 60 and 61. Because passageways 60 and 61 have pathways with directional components that are directed radially inward, any fluid influenced by the drag of backplate surface 63 is turned by the walls of the passageways to move along the passageways and thus inward toward the seal interface.

Referring to FIG. 4B, an enlargement of a portion of FIG. 4A is shown. FIG. 4B shows a portion of passageway 60 near exit 60*b*. Passageway 60 generally follows a centerline 60*c*. FIG. 4B shows that the direction of centerline 60*c* can be resolved into a component A which is generally parallel to rotational direction 74 and also preferably in the same direction as rotational direction 74. Centerline 60*b* also includes a directional component B perpendicular to directional component A, and directed generally toward exit 60*b*. Further, in some embodiments, directional component B does not intersect centerline X, but rather includes a directional component TAN that is tangent to first rotating seal member 70, second static seal 72, or seal housing 58. In contrast, some pumps include cooling passageways which are directed radially inward, such that the direction of the fluid pathway does not include any directional component parallel to the direction of rotation.

Figure 6:
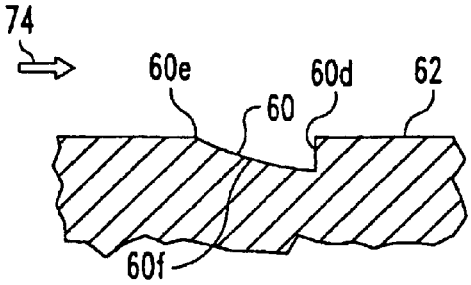
FIG. 6 is a cross-sectional view of the fluid passageway of FIG. 5 as taken along line 6—6 of FIG. 5.

FIGS. 6–9 depict cross-sectional shapes of a fluid passageway according to various embodiments of the present invention. FIG. 6 shows one cross-sectional shape for passageway 60. Passageway 60 has cross-sectional shape that is generally triangular, with boundary 60*e*, the leading edge of passageway 60 with respect to direction of rotation 74, being generally flush with surface 62. Passageway 60 includes a lower boundary 60*f* that falls away from surface 62 in the direction of rotation. Outer wall 60*d* is analogous to the "short leg" of the triangular cross-section. It is believed that having the cross-sectional area of passageway 60 increase in the direction of rotation (i.e., in the direction from leading boundary 60*e* to trailing boundary 60*d*) improves the transfer of momentum from backplate surface frictional drag into the fluid flowing within passageway 60. Although floor 60*f* of passageway 60 is shown having a curved shape, the present invention also contemplates a generally flat floor.

Figure 7:
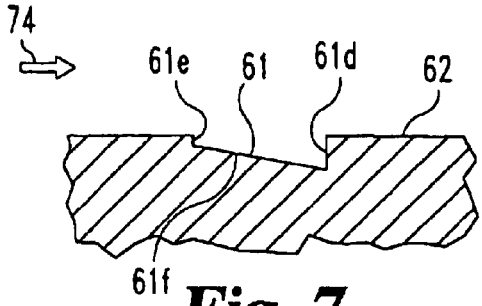
FIG. 7 is a cross-sectional view of the fluid passageway of FIG. 5 as taken along line 7—7 of FIG. 5.

FIG. 7 shows a typical cross-sectional shape for fluid passageway 61. Passageway 61 has a cross-sectional shape that is generally trapezoidal in configuration. Passageway 61 includes a leading boundary 61*e* which has a depth which is preferably parallel to the depth of trailing boundary 61*d*. Floor 61*f* falls away from housing surface 62 in the direction of rotation 74. The cross-sectional area of passageway 61 increases in the direction of flow. Although FIG. 5 depicts fluid passageways 60 and 61 with different cross-sectional shapes, the present invention contemplates embodiments in which the cross-sectional shapes of the passageways are the same or similar, and also those embodiments in which there is only a single fluid passageway, and also those embodiments in which there are more than two fluid passageways.

Figure 8:
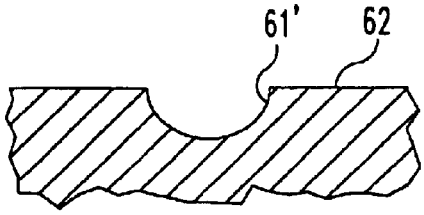
FIG. 8 is a cross-sectional view of a fluid passageway according to another embodiment of the present invention.
Figure 9:
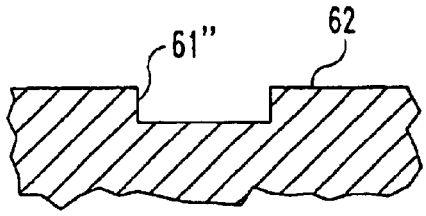
FIG. 9 is a cross-sectional view of a fluid passageway according to another embodiment of the present invention.
Figure 10:
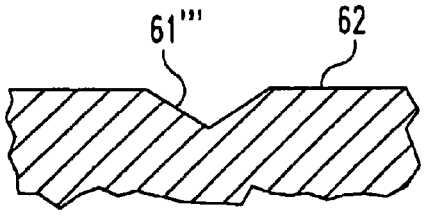
FIG. 10 is a cross-sectional view of a fluid passageway according to another embodiment of the present invention.

FIGS. 8, 9, and 10 depict semi-circular, rectangular, and v-shaped passageways 61', 61", and 61'", respectively, according to other embodiments of the present invention. The present invention also contemplates those embodiments which include cross sections having oval and trapezoidal shapes. Generally, the present invention contemplates any polygonal shape for the cross section of a passageway.

Figure 11:
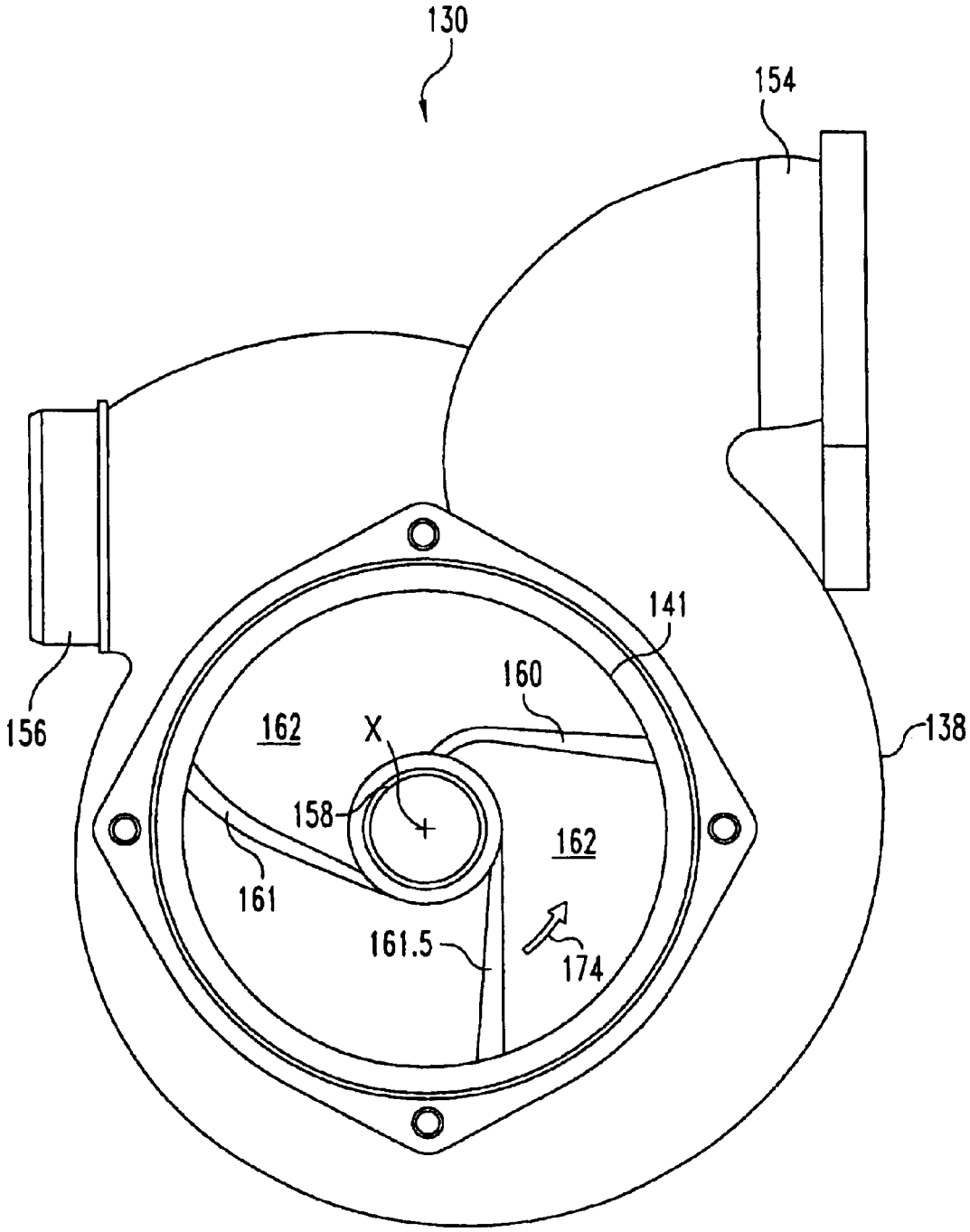
FIG. 11 is an end view of a pump with the rotor removed according to another embodiment of the present invention.

FIG. 11 is a side elevational view of another embodiment of the present invention. FIG. 5 shows a centrifugal pump assembly 130 according to another embodiment of the present invention. The use of a one-hundred series prefix (1XX) with an element number (XX) refers to an element that is the same as a non-prefixed element (XX) previously described or depicted, except for the differences which are described or depicted hereafter.

Pump assembly 130 is the same as pump 30, except for differences in the fluid passageways which will be described. Surface 162 of housing 138 includes fluid passageways 160, 161, and 161.5. Fluid passageway 160 includes a first, generally linear section from the passageway inlet toward a central position along surface 162. Fluid passageway 160 includes a second, curved portion extending from the interior end of the linear portion toward seal housing 158. Fluid passageway 161 includes a first curved portion extending from a position near the outer diameter 141 of the rotor toward a point along the interior portion of surface 162. Fluid pathway 161 further includes a linear portion extending from the end of the curved portion and proceeding in a linear path toward seal housing 158. In some embodiments, the linear end portion of passageway 161 is tangential to seal housing 158. Further, pump assembly 130 includes a third fluid passageway 161.5 which is generally linearly along its entire length from a position near rotor outer diameter 141 to seal housing 158. The centerline of fluid passageway 161.5 is preferably tangential to seal housing 158. Fluid passageways 160, 161, and 161.5 each have a direction that preferably includes a directional component that is parallel to rotational direction 174.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed:

1. A fluid pump comprising:

a centrifugal rotor having a hub and an outer diameter;

a housing for rotatably supporting said rotor and including a seal housing;

a first rotating seal member coupled to the hub of said rotor;

a second static seal member coupled within said seal housing and having a portion thereof in contact with a portion of said first seal member;

wherein said housing defines an open channel fluid passageway adapted and configured for providing a flow of fluid from the outer diameter of said rotor toward the portion of said second seal in contact with the portion of said first seal, said passageway having portion along the length thereof with a cross sectional area that decreases in the direction from the outer diameter toward the portion of said second seal.

2. The pump of claim 1 wherein said housing includes a substantially planar surface, said rotor includes a backplate spaced apart from and rotating over the surface of said housing, said fluid passageway includes a first wall intersecting the surface of said housing and a second wall intersecting the surface of said housing, and the distance between said first wall and said second wall measured perpendicular to the path of said passageway decreases in the direction from the outer diameter toward the portion of said second seal.

3. The pump of claim 1 wherein said rotor includes a substantially planar backplate, and said passageway is located in a face of said housing opposite of the backplate.

4. The pump of claim 1 wherein the path of said passageway includes a curved portion.

5. The pump of claim 1 wherein the rotor has a direction of rotation, and the path of said fluid passageway includes a directional component in the same direction as the direction of rotation.

6. The pump of claim 1 wherein the depth of said passageway decreases in the direction toward said seal housing.

7. The pump of claim 1 wherein said rotor has a direction of rotation and the depth of said passageway increases in the direction of rotation.

8. A fluid pump comprising:

a centrifugal rotor having a backplate;

a housing for rotatably supporting said rotor and including a seal housing and a surface facing said backplate;

a first rotating seal member coupled to said rotor;

a second static seal member coupled within said seal housing and having a portion thereof in contact with a portion of said first seal member;

wherein the surface of said housing includes an open channel fluid passageway, said passageway having cross sectional shape for at least a portion thereof which is selected from the group consisting of trapezoidal, triangular, oval, polygonal, and circular, said passageway directing fluid flow toward said seal housing.

9. The pump of claim 8 wherein said rotor has a direction of rotation and the depth of said passageway increases in the direction of rotation.

10. The pump of claim 9 wherein the depth of said passageway decreases in the direction toward said seal housing.

11. The pump of claim 9 wherein the depth of said passageway increases in the direction toward said seal housing.

12. A fluid pump comprising:

a centrifugal rotor having a backplate;

a housing for rotatably supporting said rotor and including a surface substantially parallel to and spaced apart from said backplate;

a first rotating seal member coupled to said rotor;

a second static seal member coupled within said housing, a portion of said second seal member being in contact with a portion of said first seal member;

wherein the surface of said housing includes an open channel fluid passageway for providing a flow of fluid to the portion of said second seal in contact with the portion of said first seal, said passageway having a curved portion along the length thereof.

13. The pump of claim 12 wherein the rotor has a direction of rotation, and the curved portion of said fluid passageway includes a directional component in the same direction as the direction of rotation.

14. The pump of claim 12 wherein the curved portion of said passageway is adapted and configured such that rotation of said backplate across the surface of said housing increases the velocity of the fluid flowing within the passageway toward the portion of said second seal.

15. The pump of claim 12 wherein the surface of said backplate spaced apart from the surface of said housing is substantially planar.

16. The pump of claim 12 wherein the path of said passageway is circular.

17. The pump of claim 12 wherein said first seal member has a diameter, and the exit of said passageway projects a path that is at least partly tangential to the diameter.

18. The pump of claim 12 wherein said rotor has a rotational axis, and said passageway is curved in a plane orthogonal to the rotational axis.

19. A fluid pump comprising:

a centrifugal rotor having a backplate and a hub;

a housing for rotatably supporting said rotor and including a seal housing and a surface facing said backplate and spaced apart from said backplate;

a first rotating seal member coupled proximate the hub of said rotor;

a second static seal member coupled within said housing, a portion of said second seal member being in contact with a portion of said first seal member;

wherein the surface of said housing includes an at least partially open-channel fluid passageway, said rotor has a direction of rotation, and said passageway is adapted and configured such that rotation of said backplate in the direction increases the energy of the fluid in said passageway flowing toward said seal housing.

20. The pump of claim 19 wherein rotation of said backplate in the direction increases the velocity of the fluid in said passageway flowing toward the portion of said second seal member.

21. The pump of claim 19 wherein rotation of said backplate in the direction increases the pressure of the fluid in said passageway flowing toward the portion of said second seal member.

22. The pump of claim 19 wherein said passageway an includes an exit and a floor, the floor including a planar ramping section proximate the exit to direct fluid flow toward said second seal portion.

23. The pump of claim 19 wherein said rotor has an outer diameter and hub, said first seal is coupled to said hub, and said passageway provides fluid from the outer diameter of said rotor toward said seal housing.

* * * * *